US011136798B2

(12) United States Patent
Park et al.

(10) Patent No.: US 11,136,798 B2
(45) Date of Patent: Oct. 5, 2021

(54) HOME APPLIANCE HAVING LEVELING DOOR HANDLE

(71) Applicants: SAMSUNG ELECTRONICS CO., LTD., Suwon-si (KR); SEOWON KOREA CO., Ltd., Gimhae-si (KR)

(72) Inventors: Wan Gi Park, Suwon-si (KR); Ji-Hoon Choi, Yongin-si (KR); Young Jun Cho, Suwon-si (KR); Han Seong Kang, Hwaseong-si (KR); Hwa Gyu Reo, Hwaseong-si (KR); Simon Ireland, Seongnam-si (KR); Byeong Woo Ahn, Yongin-si (KR); Pung Yeun Cho, Suwon-si (KR); June Young Lee, Busan (KR)

(73) Assignees: SAMSUNG ELECTRONICS CO., LTD., Suwon-si (KR); SEOWON KOREA CO., LTD., Gimhae-si (KR)

( * ) Notice: Subject to any disclaimer, the term of this patent is extended or adjusted under 35 U.S.C. 154(b) by 693 days.

(21) Appl. No.: 15/835,694

(22) Filed: Dec. 8, 2017

(65) Prior Publication Data

US 2018/0163443 A1 Jun. 14, 2018

(30) Foreign Application Priority Data

Dec. 8, 2016 (KR) ..... 10-2016-0166755

(51) Int. Cl.
*E05C 3/14* (2006.01)
*E05C 3/16* (2006.01)
(Continued)

(52) U.S. Cl.
CPC ..... *E05C 3/14* (2013.01); *A47L 15/4259* (2013.01); *D06F 39/14* (2013.01); *E05B 7/00* (2013.01);
(Continued)

(58) Field of Classification Search
CPC ..... Y10S 292/69; Y10T 292/1043; Y10T 292/1075; Y10T 292/1076;
(Continued)

(56) References Cited

U.S. PATENT DOCUMENTS 1,868,991 A * 7/1932 Pickup ..... F24C 15/022 126/39 N
2,072,820 A * 3/1937 Kessler ..... F24C 15/022 126/190
(Continued)

FOREIGN PATENT DOCUMENTS

DE 3538076 A1 * 4/1987 ..... E05C 3/08
DE 94 13 641.6 10/1994
(Continued)

OTHER PUBLICATIONS

Extended European Search Report dated Oct. 15, 2019 in corresponding European Patent Application No. 17879435.0.
(Continued)

*Primary Examiner* — Carlos Lugo
(74) *Attorney, Agent, or Firm* — Staas & Halsey LLP

(57) ABSTRACT

A home appliance in which an opening and closing operation of a door and a turning operation of a handle are connected through five joints, so that the turning operation of the handle can be performed smoothly, and a latch for fixing the door to a body moves to a position parallel to the door when the door is opened, so that a user is prevented from being interfered with the latch while opening the door and using a cavity of the home appliance.

9 Claims, 18 Drawing Sheets

(51) Int. Cl.

| | |
|---|---|
| ***D06F 39/14*** | (2006.01) |
| ***F24C 15/02*** | (2006.01) |
| ***E05B 7/00*** | (2006.01) |
| ***A47L 15/42*** | (2006.01) |
| ***E05F 1/12*** | (2006.01) |
| ***H05B 6/64*** | (2006.01) |
| ***E05D 11/00*** | (2006.01) |
| *E05C 9/22* | (2006.01) |
| *E05F 11/54* | (2006.01) |
| *E05C 9/20* | (2006.01) |
| *F25D 23/02* | (2006.01) |

(52) U.S. Cl.
CPC ..... *E05C 3/16* (2013.01); *E05C 3/165* (2013.01); *E05D 11/00* (2013.01); *E05F 1/1261* (2013.01); *F24C 15/022* (2013.01); *F24C 15/024* (2013.01); *H05B 6/6414* (2013.01); *E05C 9/20* (2013.01); *E05C 9/22* (2013.01); *E05F 11/54* (2013.01); *E05Y 2201/68* (2013.01); *E05Y 2900/30* (2013.01); *F25D 23/028* (2013.01); *Y10S 292/69* (2013.01); *Y10T 292/1043* (2015.04); *Y10T 292/1076* (2015.04)

(58) Field of Classification Search
CPC ..... Y10T 292/1078; Y10T 292/108; Y10T 292/696; Y10T 292/702; F24C 15/022; F24C 15/024; E05C 9/20; E05C 9/22
See application file for complete search history.

(56) References Cited

U.S. PATENT DOCUMENTS

| | | | | | |
|---|---|---|---|---|---|
| 2,953,419 | A * | 9/1960 | Ingolia | F24C 15/162 | 312/276 |
| 3,150,658 | A * | 9/1964 | Germain | F24C 15/023 | 126/191 |
| 3,328,062 | A * | 6/1967 | Geiger | A47L 15/4259 | 292/123 |
| 3,451,389 | A * | 6/1969 | Herbertg | F24C 15/04 | 126/200 |
| 3,889,654 | A * | 6/1975 | Kauranen | F24C 15/022 | 126/194 |
| 3,995,899 | A * | 12/1976 | Tippy | F24C 7/02 | 292/254 |
| 4,018,148 | A * | 4/1977 | Wolbrink | B30B 9/3032 | 100/345 |
| 4,750,569 | A * | 6/1988 | Flogaus | E05C 9/025 | 174/375 |
| 4,913,476 | A * | 4/1990 | Cook | E05B 17/0025 | 292/196 |
| 4,960,297 | A * | 10/1990 | Bouse | E05C 3/162 | 126/197 |
| 5,143,412 | A * | 9/1992 | Lindqvist | E05B 65/0841 | 292/200 |
| 6,789,293 | B2 * | 9/2004 | Habegger | E05F 1/1276 | 16/289 |
| 8,523,248 | B2 * | 9/2013 | Tien | E05B 65/104 | 292/194 |
| 10,551,070 | B2 * | 2/2020 | Park | E05B 53/00 | |
| 2003/0116974 | A1 | 6/2003 | Cole | | |
| 2005/0023843 | A1 | 2/2005 | Bartmann et al. | | |
| 2007/0296224 | A1 | 12/2007 | Courter | | |
| 2014/0035453 | A1 | 2/2014 | Kwon et al. | | |
| 2016/0333624 | A1 | 11/2016 | Choi | | |
| 2018/0292094 | A1 | 10/2018 | Park | | |

FOREIGN PATENT DOCUMENTS

| | | | | |
|---|---|---|---|---|
| DE | 102013001905 | A1 * | 8/2014 | F24C 7/085 |
| EP | 0 659 960 | A2 | 6/1995 | |
| EP | 2093492 | A2 * | 8/2009 | F24C 15/024 |
| KR | 10-2004-0061317 | | 7/2004 | |
| KR | 20-2010-0000063 | | 1/2010 | |
| KR | 10-2014-0018565 | | 2/2014 | |
| KR | 10-1480241 | | 12/2014 | |
| KR | 10-2016-0032420 | | 3/2016 | |
| WO | WO 2017/179961 | A1 | 10/2017 | |

OTHER PUBLICATIONS

International Search Report, PCT/ISA/210, dated Apr. 3, 2018, in corresponding International Patent Application No. PCT/KR2017/014387.
Communication pursuant to Article 94(3) EPC dated Nov. 2, 2020, in corresponding European Patent Application No. 17 879 435.0.
Indian Office Action dated Oct. 19, 2020, in corresponding Indian Patent Application No. 201917021099.

* cited by examiner

HOME APPLIANCE HAVING LEVELING DOOR HANDLE

CROSS-REFERENCE TO RELATED APPLICATION(S)

This application claims the benefit of Korean Patent Application No. 10-2016-0166755, filed on Dec. 8, 2016 in the Korean Intellectual Property Office, the disclosure of which is incorporated herein by reference.

BACKGROUND

1. Field

Embodiments of the present disclosure relate to a home appliance having a leveling door handle.

2. Description of Related Art

A home appliance having a cavity is provided with a door capable of opening and closing the cavity, wherein the home appliance includes a cooking apparatus, a dishwasher, a refrigerator, and a washing apparatus. The door is provided with a handle held by a user' hand to allow the user to open and close the door, and the handle has a shape protruded from the door or a shape recessed in the door.

The handle protruded from the door is spaced from the front surface of the door by a predetermined distance so as to allow the user to hold therein. The handle is fixed to the door to rotate integrally with the door. That is, the relative position of the handle with respect to the door is fixed according to the rotation of the door, and thus the inconveniences may occur in the operation of opening and closing of the door.

For example, as for a pull-down type door which can be opened and closed by pulling the handle and applying the downward force to the handle at the same time, the back of user hand may be touched to an upper portion of the door while the door is lowered, and thus the users hand may be damaged. In addition, after the door is opened and then dropped down, the user may not see the position of the handle and thus the user should grope the direction of the position of the handle to lift the door. Accordingly, although a movable type-handle in which the handle moves according to the operation of the door is designed, it is required to improve the user convenience and the reliability thereof.

SUMMARY

Therefore, it is an aspect of the present disclosure to provide a home appliance capable of allowing an angle of a handle to be variable according to an opening and closing angle of a door so that a user easily holds the handle when the user opens and closes the door.

It is another aspect of the present disclosure to provide a home appliance capable of allowing an angle of a handle to be smoothly and accurately changed according to an opening and closing angle of a door.

It is another aspect of the present disclosure to provide a home appliance capable of allowing an angle of a latch fixing a door to be variable according to an opening and closing angle of the door when the door is opened and closed.

Additional aspects of the present disclosure will be set forth in part in the description which follows and, in part, will be obvious from the description, or may be learned by practice of the present disclosure.

In accordance with an aspect of the present disclosure, a home appliance includes a body provided with a cavity; a door rotatably coupled to the body to open and close the cavity; a handle coupled to the door to rotate in linkage with a rotation of the door with respect to the body; and a latch coupled to the door, the latch being configured to fix the door to the body when the door closes the cavity provided in the body of the home appliance, and to rotate in linkage with the rotation of the door with respect to the body and to rotate in linkage with in linkage with a rotation of the handle with respect to the door.

The home appliance may further include a link rod configured to connect the body to the handle so as to rotate the handle in linkage with the rotation of the door with respect to the body.

The link rod may include a first link rod and a second link rod which are rotatably coupled to each other.

One side of the first link rod may be coupled to the body, the other side of the first link rod may be coupled to one side of the second link rod, and the handle may be coupled to the other side of the second link rod.

The second link rod may be configured to move linearly with respect to the door.

The second link rod may include a guide protrusion, wherein the door may include an elongated guide groove configured to guide the guide protrusion when the second link rod moves linearly with respect to the door.

The latch may be configured to rotate in linkage with the linear movement of the second link rod when the second link rod moves linearly with respect to the door.

The second link rod may include a pressing portion configured to press the latch to rotate the latch, wherein the latch may include an active portion interrupted by the pressing portion.

The latch may include a locking portion provided with a locking groove configured to fix the latch to the door, the latch may be configured to be rotated between a locking position in which the locking portion is perpendicular to the rear surface of the door, and a hidden position in which the locking portion is parallel to the rear surface of the door.

The latch may be placed in the locking position when the door closes the cavity and the latch rotated between the locking position and the hidden position when the door is rotated to open the cavity.

The home appliance may further include a first joint configured to allow the body and the door to be rotatably coupled to each other; a second joint configured to allow the body and the first link rod to be rotatably coupled to each other; a third joint configured to allow the first link rod and the second link rod to be rotatably coupled to each other; a fourth joint configured to allow the second link rod and the handle to be rotatably coupled to each other; and a fifth joint configured to allow the door and the handle to be rotatably coupled to each other.

The home appliance may further include a sixth joint configured to allow the door and the latch to be rotatably coupled to each other.

In accordance with another aspect of the present disclosure, a home appliance includes a body provided with a cavity; a door rotatably coupled to the body to open and close the cavity; a latch rotatably coupled to the door and configured to fix the door to the body when the door closes the cavity provided in the body of the home appliance; and a link rod configured to connect the body to the latch so that the latch rotates with respect to the door in linkage with a rotation of the door with respect to the body.

The link rod may include a first link rod and a second link rod which are rotatably coupled to each other.

One side of the first link rod may be coupled to the body, the other side of the first link rod may be coupled to one side of the second link rod, and the latch may be coupled to the other side of the second link rod.

The second link rod may be configured to move linearly with respect to the door.

The latch may be configured to rotate in linkage with the second link rod when the second link rod moves linearly with respect to the door.

In accordance with still another aspect of the present disclosure, a home appliance may include a body provided with a cavity; a door rotatably coupled to the body to open and close the cavity provided in the body of the home appliance; a first link rod rotatably coupled to the body; and a second link rod rotatably coupled to the first link rod, wherein the door includes a guide groove configured to guide the second link rod such that the second link rod moves linearly with respect to the door.

The second link rod may include a guide protrusion inserted into the guide groove.

The guide protrusion may include a plurality of protrusions apart from each other along a longitudinal direction of the guide groove.

BRIEF DESCRIPTION OF THE DRAWINGS

These and/or other aspects of the disclosure will become apparent and more readily appreciated from the following description of embodiments, taken in conjunction with the accompanying drawings of which:

FIG. 8 illustrates a state in which the door is closed, FIG. 9 illustrates a state in which the door is half opened, and FIG. 10 illustrates a state in which the door is fully opened.

FIG. 12 illustrates a state in which a door is closed, FIG. 13 illustrates a state in which the door is half opened, and FIG. 14 illustrates a state in which the door is fully opened.

FIG. 16 illustrates a state in which a door is closed, FIG. 17 illustrates a state in which the door is half opened, and FIG. 18 illustrates a state in which the door is fully opened.

DETAILED DESCRIPTION

Figure 1:
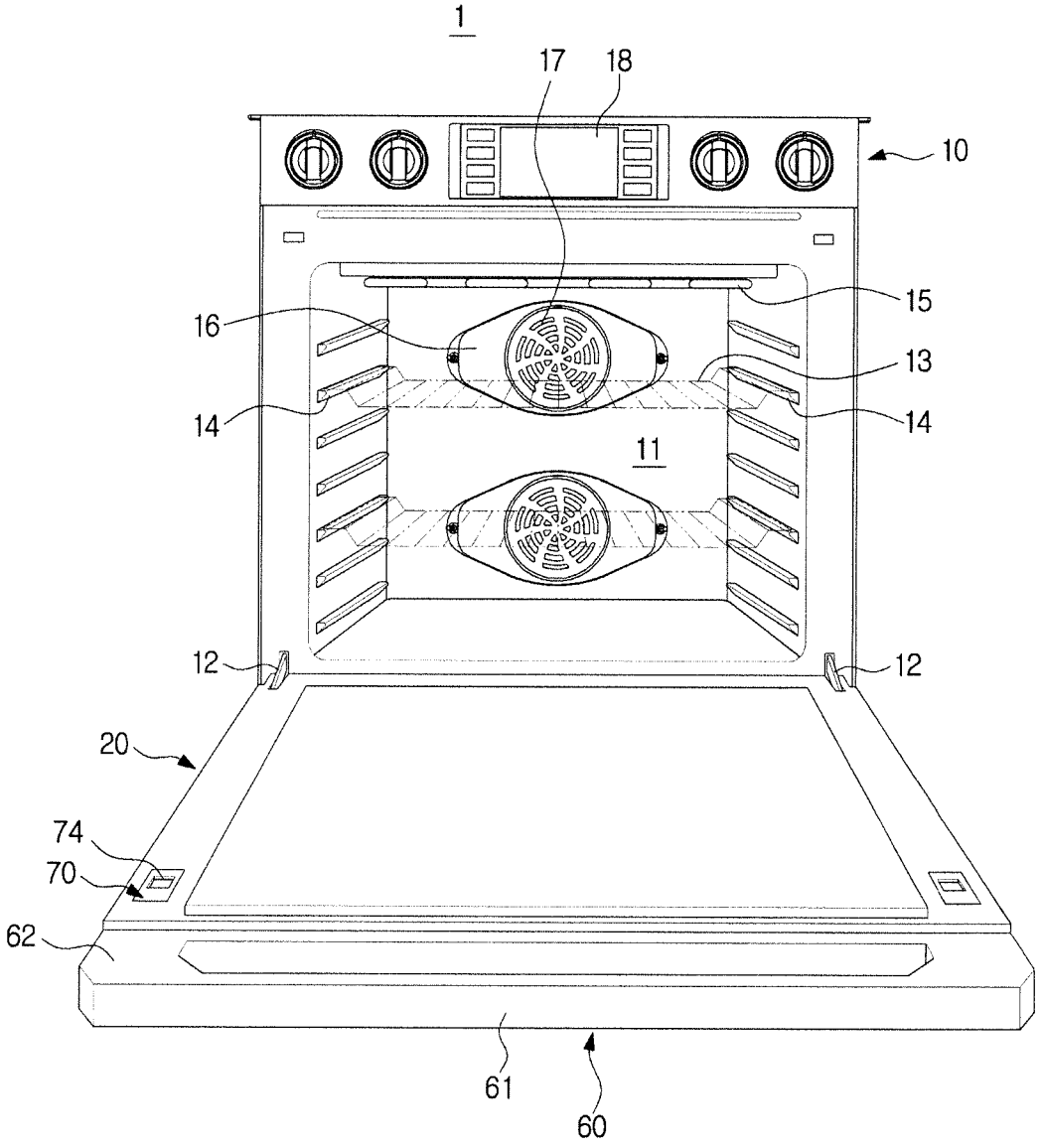
FIG. 1 is a view illustrating a home appliance in accordance with an embodiment of the present disclosure.

Embodiments described in the present disclosure and configurations shown in the drawings are merely examples of the embodiments of the present disclosure, and may be modified in various different ways at the time of filing of the present application to replace the embodiments and drawings of the present disclosure.

Hereinafter embodiments of the present disclosure will be described with reference to the drawings.

FIG. 1 is a view illustrating a home appliance in accordance with an embodiment of the present disclosure. Hereinafter an embodiment of the present disclosure will be described with reference to FIG. 1.

A home appliance 1 may include a body 10 having a cavity 11 provided therein and a door 20 opening and closing the cavity 11. FIG. 1 illustrates an oven as an example of the home appliance 1, but is not limited thereto. Therefore, a home appliance includes a microwave oven, a dish washer, a refrigerator, and a washing apparatus having a cavity 11 provided therein, a body 10, and a door 20 opening and closing the cavity 11.

The body 10 may have an approximately box shape and the cavity 11 may be provided with one surface, which is opened so that food is inserted into or pulled out. A rack 13 used for holding foods may be mounted to the cavity 11. For this, a supporting rib 14 may be provided in opposite sides of the body 10 to allow the rack 13 to be placed.

A heater 15 heating the inside of the cavity 11 may be provided in the cavity 11. The heater 15 may include an electric resistor generating heat when the current flows, or a combustion device generating heat by burning gas.

A circulating fan circulating air to heat food evenly may be provided in the rear side of the cavity 11 and a fan cover 16 covering the circulating fan may be provided in front of the circulating fan. A through hole 17 allowing air to flow may be formed in the fan cover 16.

The door 20 may be configured to open and close the opened one surface of the cavity 11. According to an embodiment, a front surface of the cavity 11 may be opened, and the door 20 may be provided in front of the cavity 11 to open and close the opened front surface of the cavity 11. However, the position of the door 20 is not limited thereto, and thus the cavity 11 may be provided to allow an upper surface thereof to be opened and the door 20 may be provided in the upper portion of the cavity 11 to open and close the opened upper surface of the cavity 11.

The door 20 may be rotatably provided with respect to the body 10. According to an embodiment, the door 20 has a pull-down structure in which, when a user pulls the door 20, the door 20 falls downward while rotating with respect to a rotation shaft in the lower side, but is not limited thereto. Therefore, the door 20 may have a pull-side structure in which the door 20 is opened and closed in the left and right direction.

The body 10 may include a hinge bracket 12 provided in the lower side to allow the door 20 to be rotatably coupled thereto. The hinge bracket 12 may be fixed to the body 10 such that one portion of the hinge bracket 12 is protruded to the front side of the body 10

A handle 60 configured to be pulled by the hand may be provided in the upper portion of the door 20 to open the door 20. The handle 60 may be protruded from the front surface of the door 20. That is, the handle 60 may include a grip portion 61 configured to be gripped by the hand and a spacer portion 62 provided in opposite sides of the grip portion 61 to protrude the grip portion 61 from the front surface of the door 20, so that a user puts his or her hands between the grip portion 61 and the front surface of the door 20.

The handle 60 may be rotatably coupled to the door 20, and the rotation of the handle 60 may interlock with the rotation of the door 20 with respect to the body 10. When the door 20 is closed, the handle 60 may be horizontally provided with respect to the bottom surface, and as the door 20 is opened, the handle 60 may be maintained to be horizontal with respect to the bottom surface of the handle 60.

A latch 70 may be provided in the door 20, or coupled to the door 20, to fix the door 20 in a state in which the door 20 is closed. The latch 70 may include a locking groove 74 and the body 10 may include a catch (not shown) inserted into the locking groove 74 to fix the latch 70 to the door 20.

The latch 70 may be rotatably provided in a rear surface of the door 20, and the rotation of the latch 70 may interlock with the rotation of the door 20 about the body 10. That is, when the door 20 is closed, the latch 70 may be placed in a locking position that is perpendicular to the rear surface of the door 20. When the door 20 is fully opened, the latch 70 may be placed in a hidden position that is parallel to the rear surface of the door 20.

Hereinafter, a structure in which the handle 60 rotates in linkage with the rotation of the door 20 with respect to the body 10, and a structure in which the latch 70 rotates in linkage with the rotation of the door 20, with respect to the body 10, will be described in detail.

Figure 2:
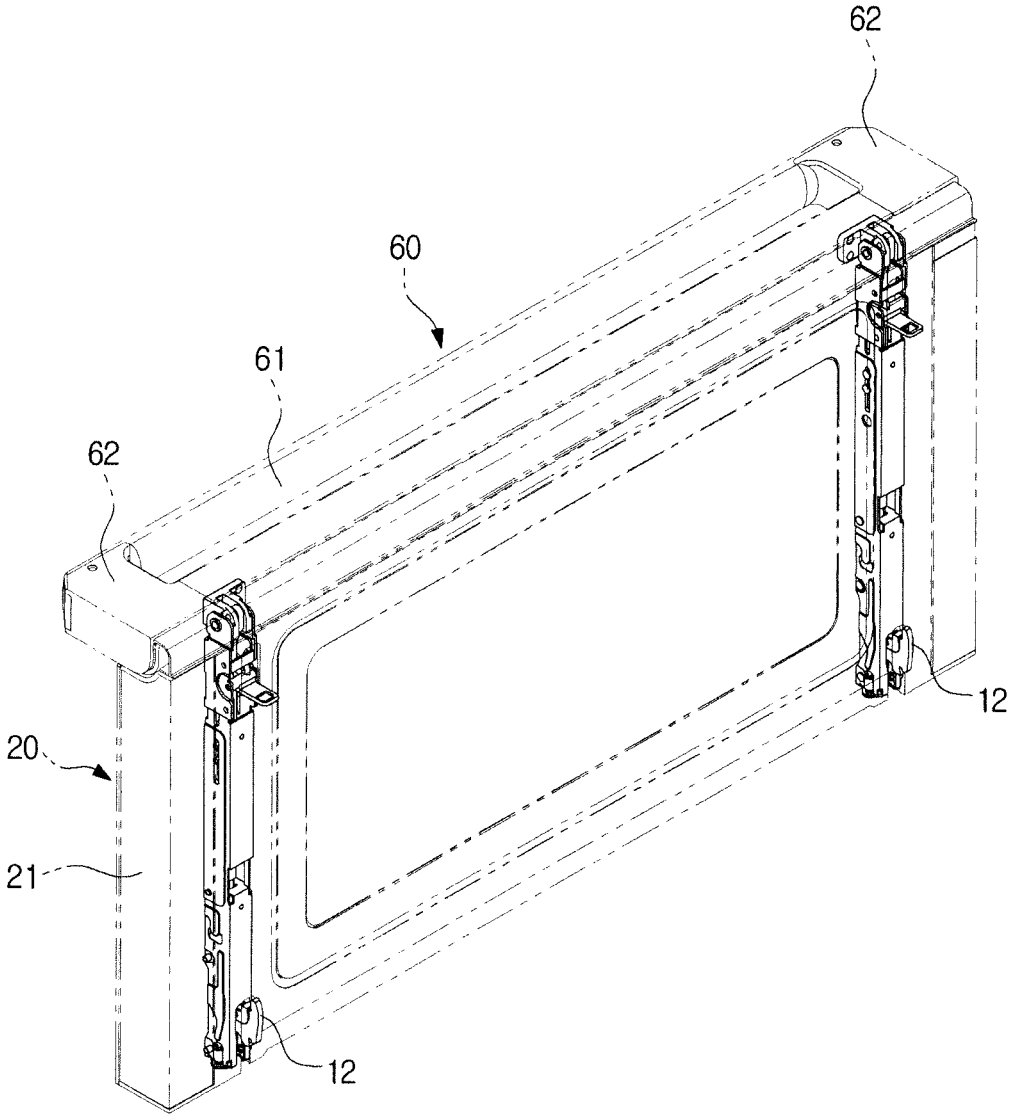
FIG. 2 is a perspective view schematically illustrating a door of the home appliance of FIG. 1.

FIG. 2 is a perspective view schematically illustrating a door 20 of the home appliance 1 of FIG. 1.

Figure 3:
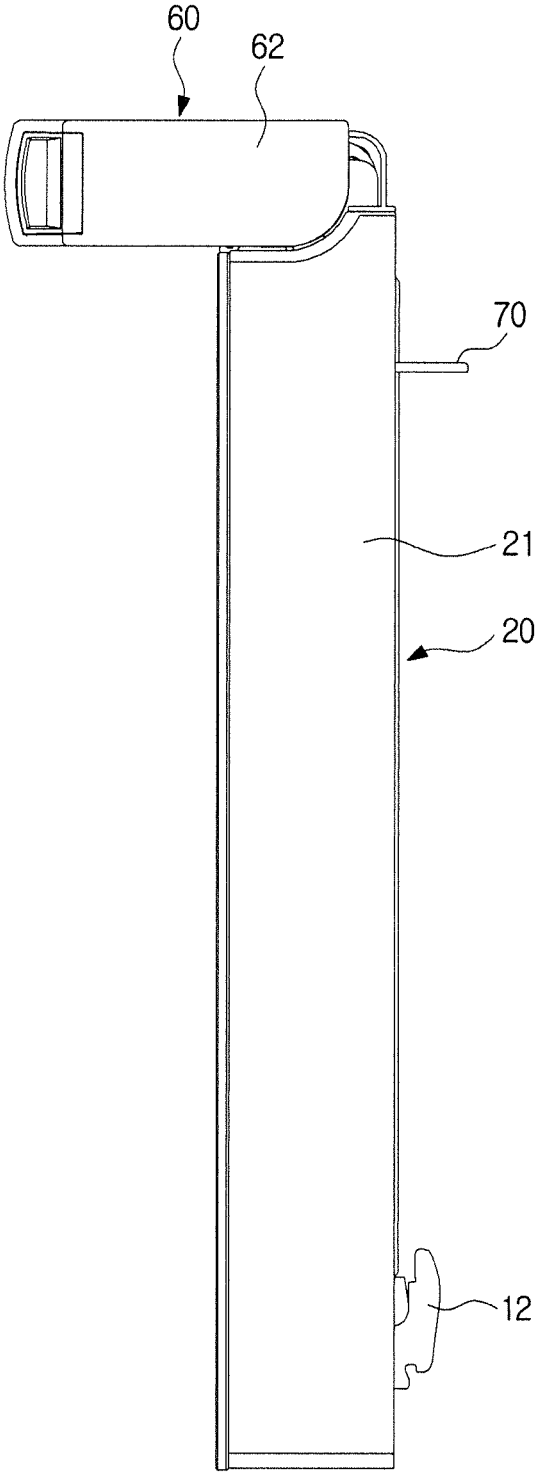
FIG. 3 is a side view schematically illustrating the door of the home appliance of FIG. 1.
Figure 4:
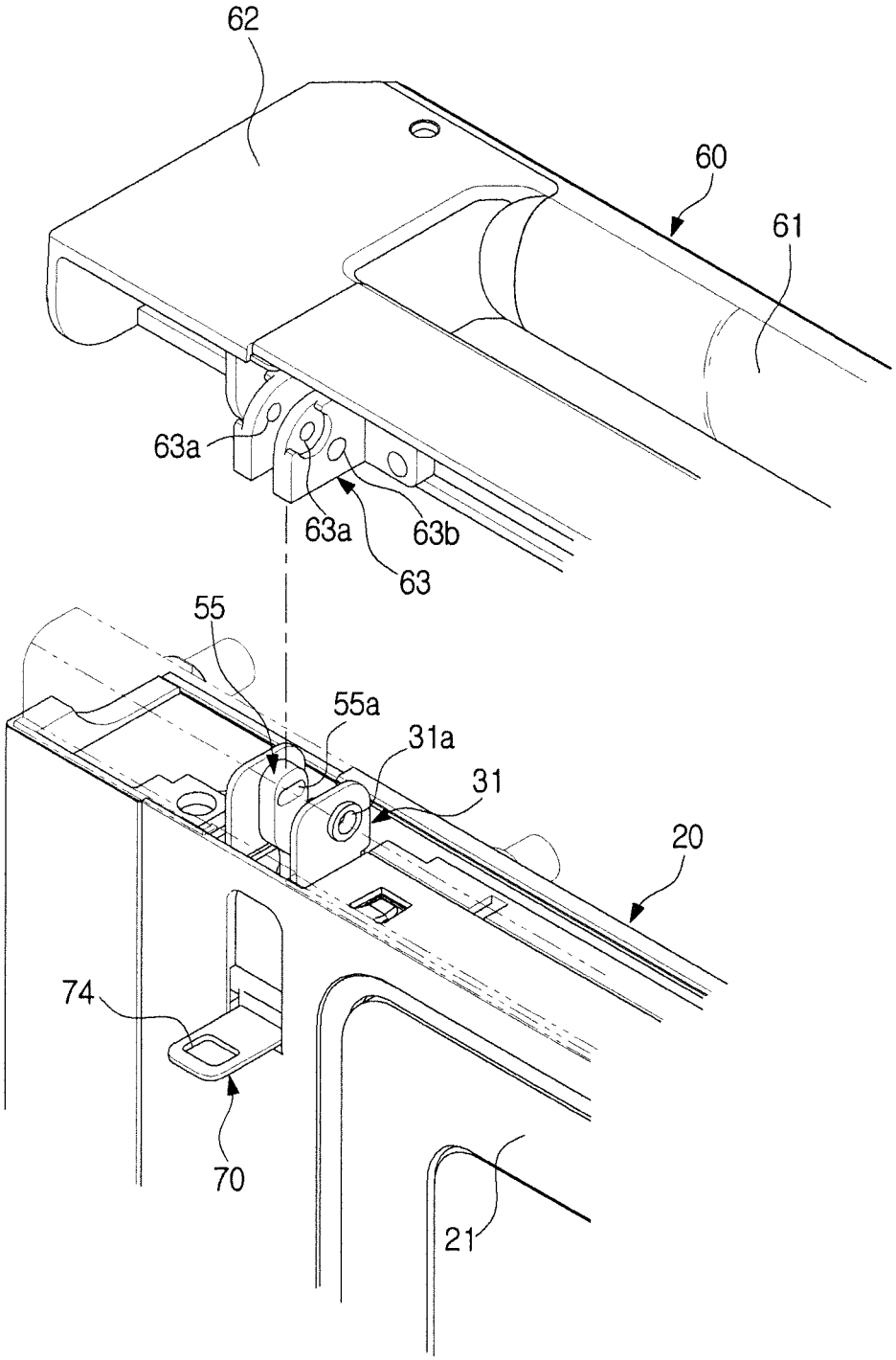
FIG. 4 is a view illustrating a coupling structure between the door and a handle in the home appliance of FIG. 1.
Figure 5:
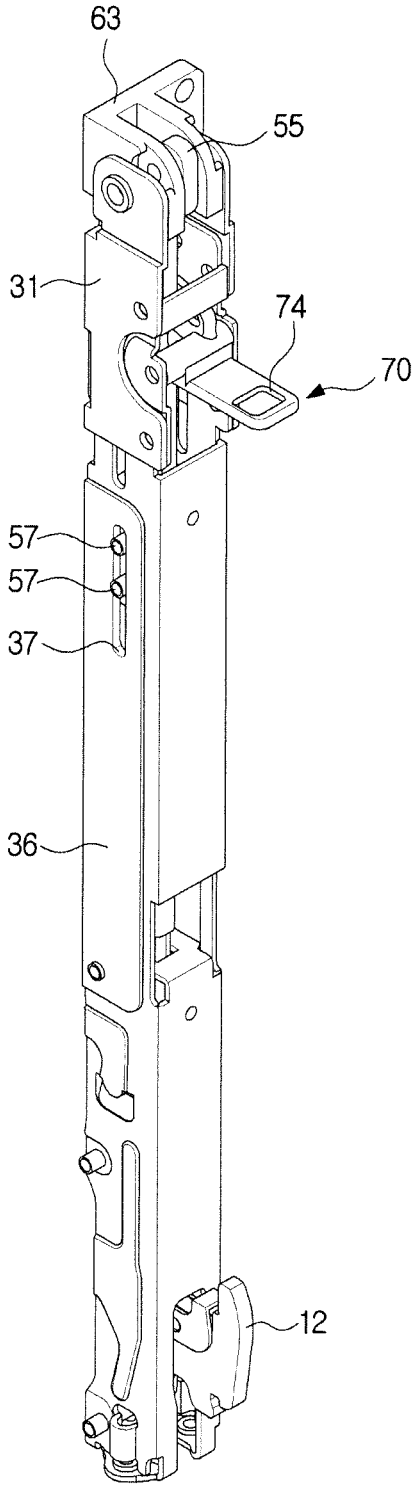
FIG. 5 is a perspective view illustrating a link unit of the home appliance of FIG. 1.
Figure 6:
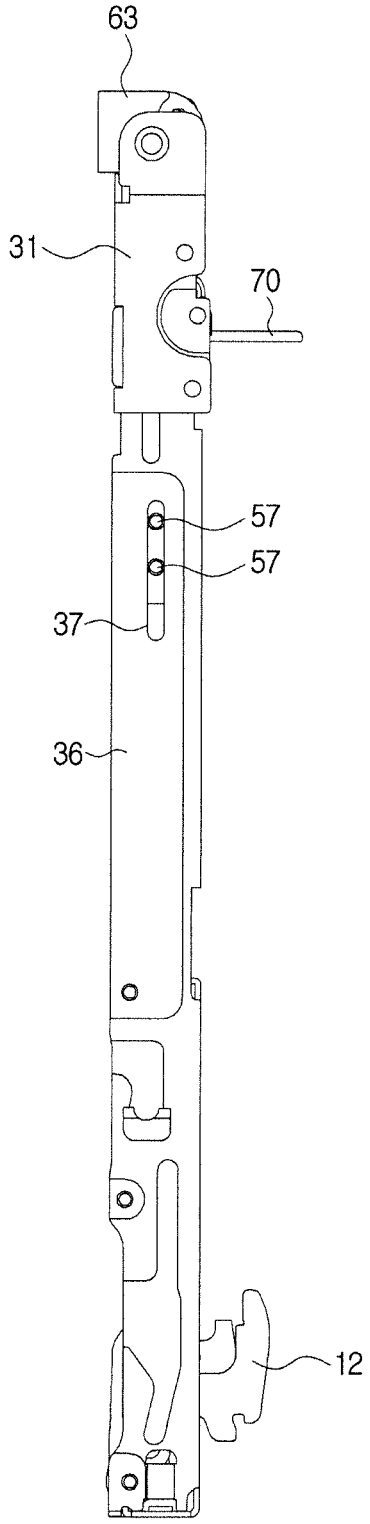
FIG. 6 is a side view illustrating the link unit of the home appliance of FIG. 1.
Figure 7:
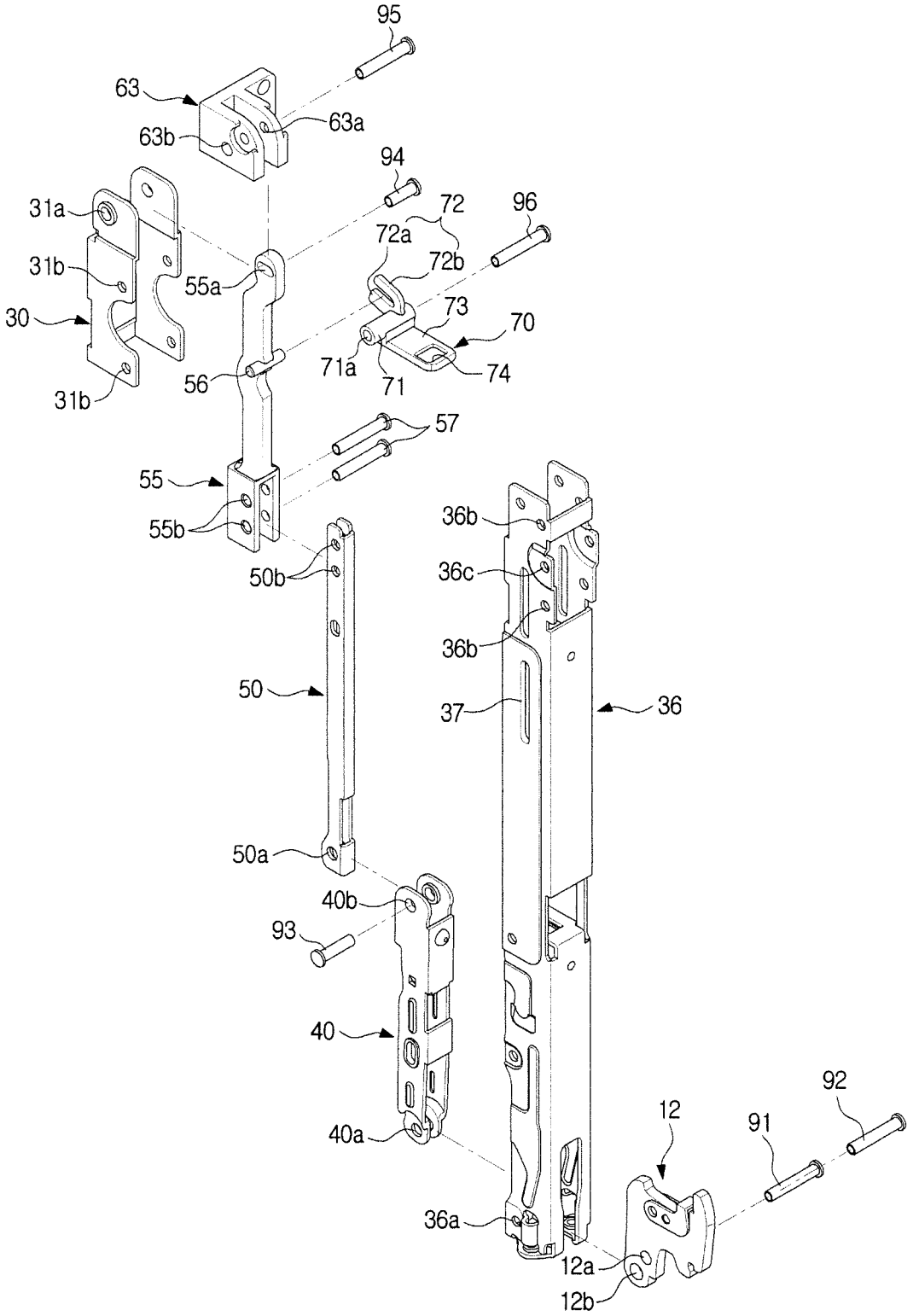
FIG. 7 is an exploded view illustrating the link unit of the home appliance of FIG. 1.
Figure 8:
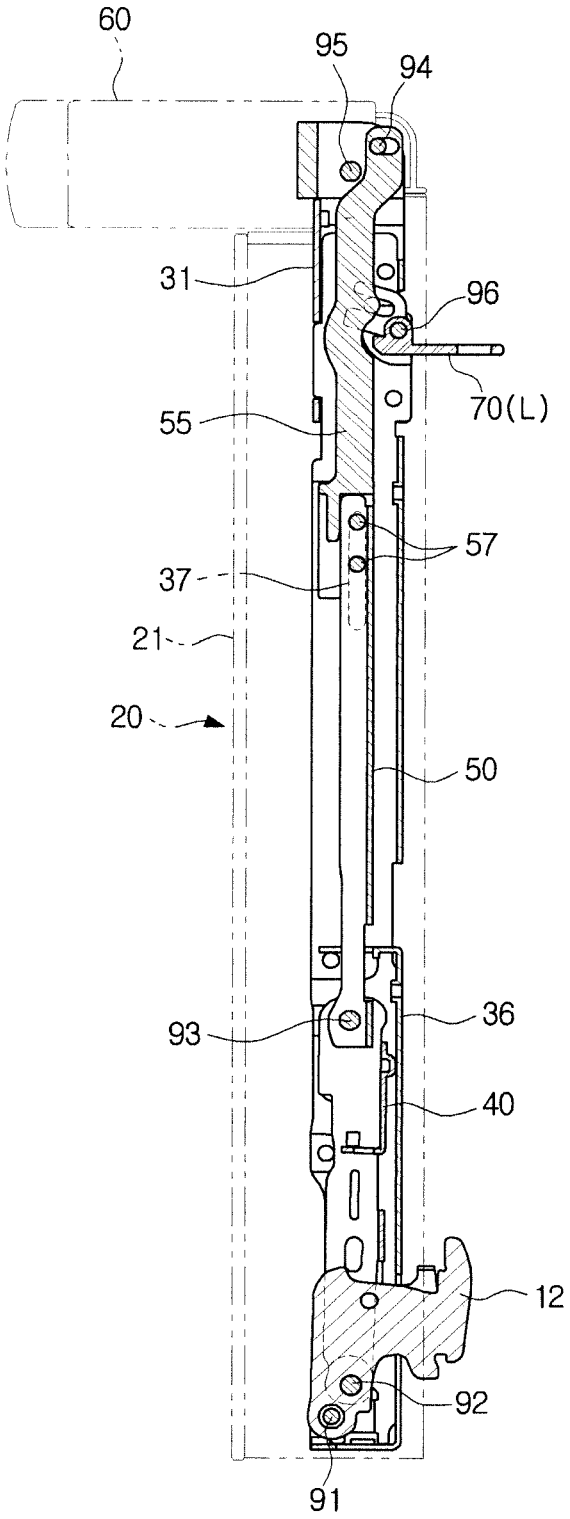
FIGS. 8 to 10 are cross-sectional views illustrating the link unit of the home appliance of FIG. 1, particularly.
Figure 9:
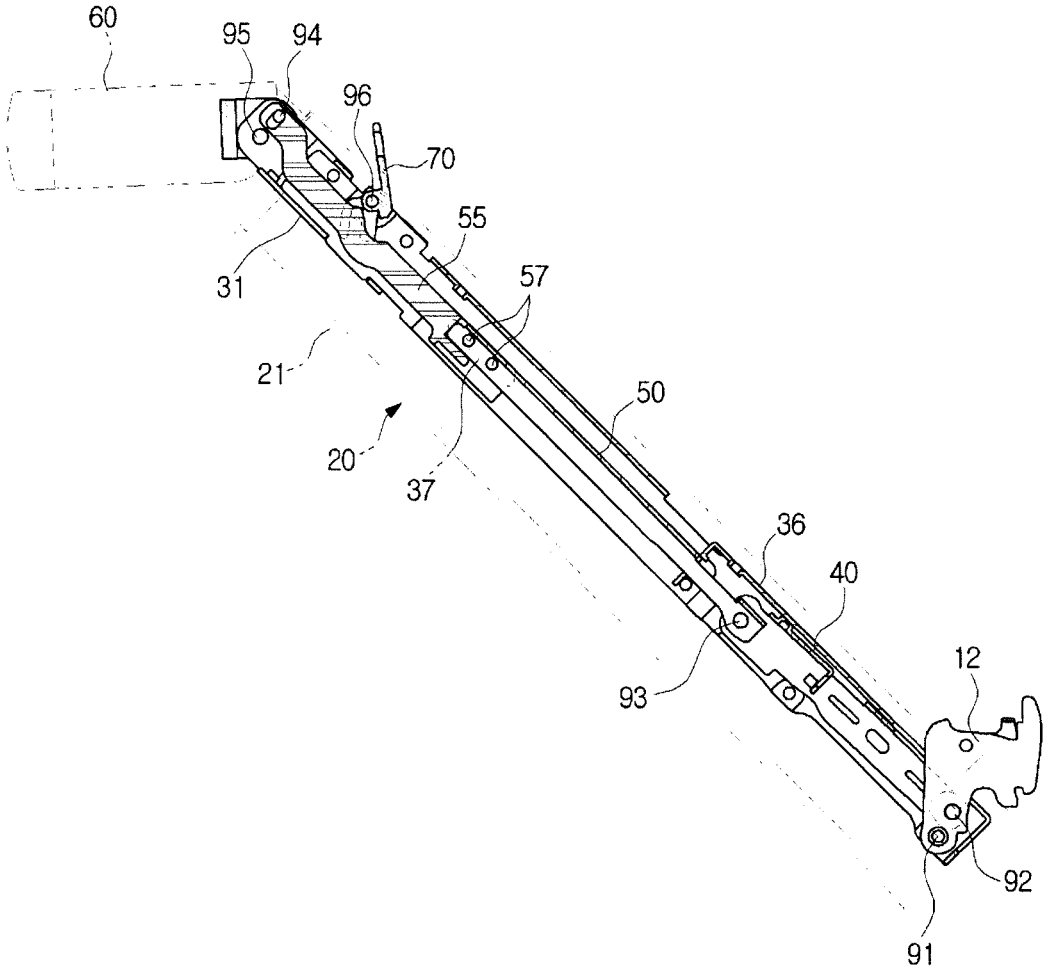
Figure 10:
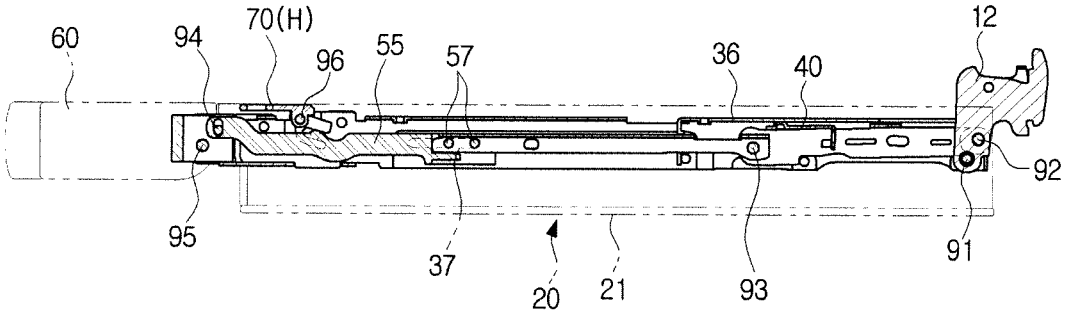

FIG. 3 is a side view schematically illustrating the door 20 of the home appliance 1 of FIG. 1. FIG. 4 is a view illustrating a coupling structure between the door 20 and a handle 60 in the home appliance 1 of FIG. 1. FIG. 5 is a perspective view illustrating a link unit of the home appliance 1 of FIG. 1. FIG. 6 is a side view illustrating the link unit of the home appliance 1 of FIG. 1. FIG. 7 is an exploded view illustrating the link unit of the home appliance 1 of FIG. 1. FIGS. 8 to 10 are cross-sectional views illustrating the link unit of the home appliance 1 of FIG. 1, particularly, FIG. 8 illustrates a state in which the door 20 is closed, FIG. 9 illustrates a state in which the door 20 is half opened, and FIG. 10 illustrates a state in which the door 20 is fully opened.

Hereinafter, a description will be described with reference to FIGS. 2 to 10. A link unit may include the hinge bracket 12, a handle bracket 63, link housings 31 and 36, and link rods 40, 50 and 55, the latch 70, and joints 91, 92, 93, 94, and 95.

The handle 60 may include the handle bracket 63 fixedly coupled to the grip portion 61 or the spacer portion 62. The handle bracket 63 may be rotatably coupled to a second B link rod 55 and the door 20, respectively.

For this, the handle bracket 63 may include a fourth joint hole 63*a* to be coupled to the second B link rod 55, and a fifth joint hole 63*b* to be coupled to the upper link housing 31.

The door 20 may include the link housings 31 and 36 fixed to a door body 21. The link housings 31 and 36 may accommodate the link rods 40, 50 and 55. The link housings 31 and 36 may include an upper link housing 31 and a lower link housing 36. According to an embodiment, the upper link housing 31 and the lower link housing 36 may be separately provided or integrally provided by using a separate coupling member (not shown). Alternatively, the upper link housing 31 and the lower link housing 36 may be integrally formed.

The upper link housing 31 may include a fifth joint hole 31*a* to be coupled to the handle bracket 63 and a coupling hole 31*b* to be coupled to the upper link housing 31.

The lower link housing 36 may include a first joint hole 36*a* to be coupled to the hinge bracket 12, a coupling hole 36*b* to be coupled to the upper link housing 31 and a sixth joint hole 36*c* to be coupled to the latch 70.

The lower link housing 36 may include a guide groove 37 to guide a guide protrusion 57. The guide groove 37 may be elongated along a longitudinal direction of the lower link housing 36. By the guide groove 37, the second link rods 50 and 55 may perform linear movement with respect to the door 20. A plurality of guide protrusions 57 may be provided apart from each other at a predetermined distance along the longitudinal direction of the guide groove 37, so that the second link rods 50 and 55 stably perform the linear movement.

The home appliance 1 may include the link rods 40, 50 and 55 connecting the body 10 to the handle 60 so that the handle 60 rotates in linkage with the rotation of the door 20 with respect to the body 10.

The link rods 40, 50 and 55 may include a first link rod 40 and the second link rods 50 and 55. The second link rods 50 and 55 may include the second A link rod 50 and the second B link rod 55.

The first link rod 40 and the second link rods 50 and 55 may be rotatably coupled to each other. According to an embodiment, the second A link rod 50 and the second B link rod 55 may be separately provided and then integrated by being coupled to each other by the guide protrusion 57. Alternatively, the second A link rod 50 and the second B link rod 55 may be integrally formed.

The first link rod 40 may include a first joint hole 40*a* to be coupled to the hinge bracket 12 and a third joint hole 40*b* to be coupled to the second A link rod 50.

The second A link rod 50 may include a third joint hole 50*a* to be coupled to the first link rod 40 and a coupling hole 50*b* to be coupled to the second B link rod 55.

The second B link rod 55 may include a fourth joint hole 55*a* to be coupled to the handle bracket 63 and a coupling hole 55*b* to be coupled to the second A link rod 50. The fourth joint hole 55*a* may be formed in an elongated hole shape.

The second link rods 50 and 55 may include a pressing portion 56 pressing the latch 70 to be rotated. The pressing portion 56 may rotate the latch 70 by pressing an active portion 72*a* or an active portion 72*b* of the latch 70 when the second link rods 50 and 55 perform the linear movement with respect to the door 20.

The latch 70 may include a latch body 71 provided in the cylindrical shape, a locking portion 73, in which the locking groove 74 is formed, so that the catch (not shown) provided in the body 10 is inserted and locked thereto, and an active portion 72 pressed by the pressing portion 56 of the second link rods 50 and 55.

The latch body 71, the locking portion 73 and the active portion 72 may be integrally formed. A sixth joint hole 71*a* may be provided in the latch body 71 to be coupled to the door 20.

The latch 70 may be rotated between the locking position L (refer to FIG. 8) approximately perpendicular to the rear surface of the door 20, and the hidden position H (refer to FIG. 10) approximately parallel to the rear surface of the door 20. When the door 20 is closed, the latch 70 may be placed in the locking position L and when the door 20 is fully opened, the latch 70 may be placed in the hidden position H.

For this, the active portion 72 may include the first active position 72*a* pressed by the pressing portion 56 of the second link rods 50 and 55 when the second link rods 50 and 55 linearly move downward with respect to the door 20 according to the opening of the door 20, and the second active position 72*b* pressed by the pressing portion 56 of the second link rods 50 and 55 when the second link rods 50 and 55 linearly move upward with respect to the door 20 according to the closing of the door 20.

By using the above mentioned structure, since the latch 70 is placed in the hidden position H when the door 20 is opened, a case, in which a user is interrupted by the protruding latch 70, may be prevented in advance and the exterior may be improved.

The home appliance 1 may include five joints 91, 92, 93, 94, and 95, so that the handle 60 rotates in linkage with the rotation of the door 20 with respect to the body 10.

The joints 91, 92, 93, 94, and 95 may allow two components to be rotatably coupled to each other and form a rotation axis of the two components.

A first joint 91 may allow the body 10 and the door 20 to be rotatably coupled to each other. The first joint 91 may be inserted into the first joint hole 12*a* formed in the hinge bracket 12 of the body 10 and into the first joint hole 36*a* formed in the lower link housing 36 of the door 20.

A second joint 92 may allow the body 10 and the first link rod 40 to be rotatably coupled to each other. The second joint 92 may be inserted into the second joint hole 12*b* formed in the hinge bracket 12 of the body 10 and into the second joint hole 40*a* formed in the first link rod 40.

A third joint 93 may allow the first link rod 40 and the second rod 50 and 55 to be rotatably coupled to each other. The third joint 93 may be inserted into the third joint hole 40*b* formed in the first link rod 40 and into the third joint hole 50*a* formed in the second A link rod 50.

A fourth joint 94 may allow the second rod 50 and 55 and the handle 60 to be rotatably coupled to each other. The fourth joint 94 may be inserted into the fourth joint hole 55*a* formed in the second B link rod 55 and into the fourth joint hole 63*a* formed in the handle bracket 63 of the handle 60.

A fifth joint 95 may allow the handle 60 and the door 20 to be rotatably coupled to each other. The fifth joint 95 may be inserted into the fifth joint hole 63*b* formed in the handle bracket 63 of the handle 60 and into the fifth joint hole 31*a* formed in the upper link housing 31 of the door 20.

A latch rotation shaft 96 may allow the latch 70 and the door 20 to be rotatably coupled to each other. The latch rotation shaft 96 may be inserted into a latch rotation shaft hole 71*a* formed in the latch 70 and into the sixth joint hole 36*c* formed in the lower link housing 36 of the door 20.

As illustrated in FIGS. 8 to 10, by using the above mentioned structure, in a process in which the door 20 is opened, a rotation angle of the first link rod 40 may become larger than a rotation angle of the door 20 due to a difference in a position of the first joint 91 and the position of the second joint 92, and thus the first link rod 40 may pull the second link rods 50 and 55.

As the first link rod 40 pulls the second link rods 50 and 55, the second link rods 50 and 55 may linearly move downward with respect to the door 20.

As a result, when the second link rods 50 and 55 perform the linear movement, the handle 60 may be rotated with respect to the door 20 due to a difference in the position of the fourth joint 94 and the position of the fifth joint 95, and then the pressing portion 56 of the second link rods 50 and 55 may press the active portion 72 of the latch 70 to allow the latch 70 to be rotated.

As mentioned above, the handle 60 interlocked with the rotation of the door 20 may be more smoothly and readily moved since five joint are used and the second link rods 50 and 55 perform the linear movement with respect to the door 20. That is, since a radius of gyration of the first link rod 40 corresponding to a distance between the second joint 92 and the third joint 93 is shorter than a radius of gyration of the door 20 corresponding to a distance between the first joint 91 and the fifth joint 95, the first link rod 40 may be smoothly and readily rotated when the door 20 is opened and closed, and accordingly, the handle 60 may be smoothly and readily rotated.

Since the second link rods 50 and 55 perform the linear movement, it may be easy to convert the movement of the second link rods 50 and 55 into the rotational movement of the latch 70.

Figure 11:
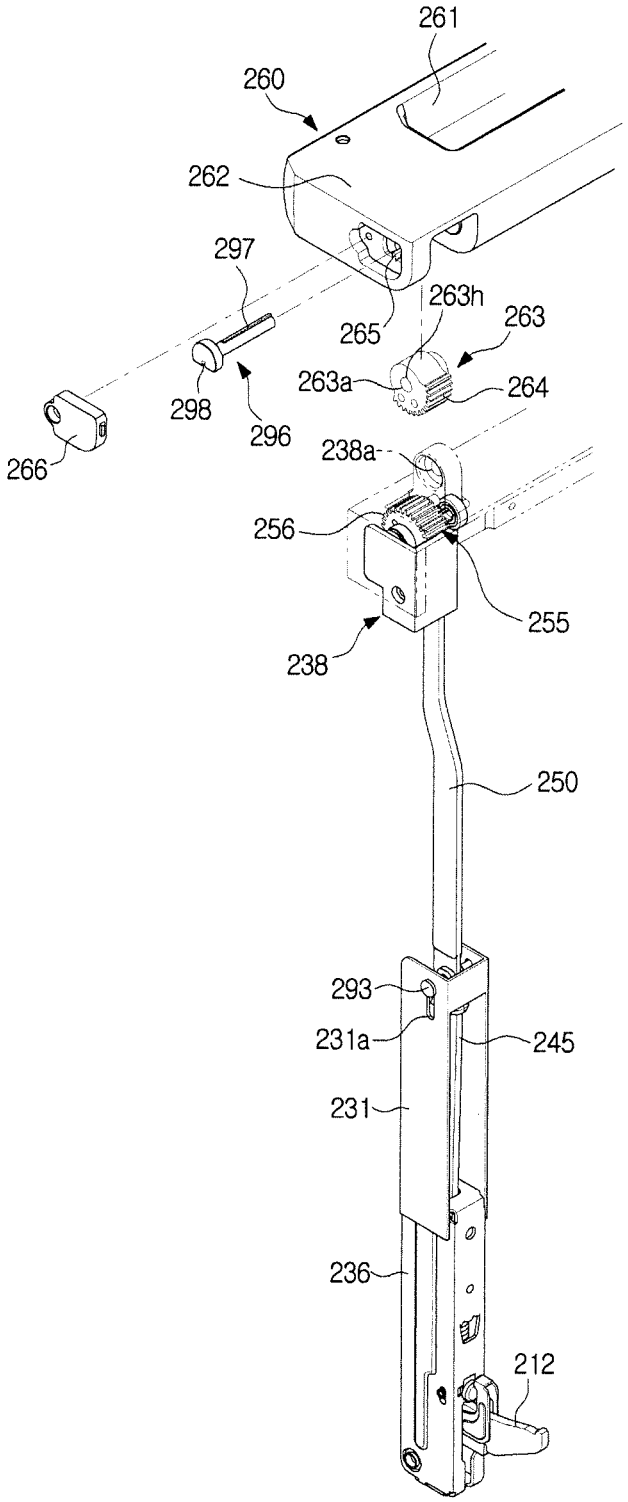
FIG. 11 is a view illustrating a link unit in accordance with another embodiment of the present disclosure.
Figure 12:
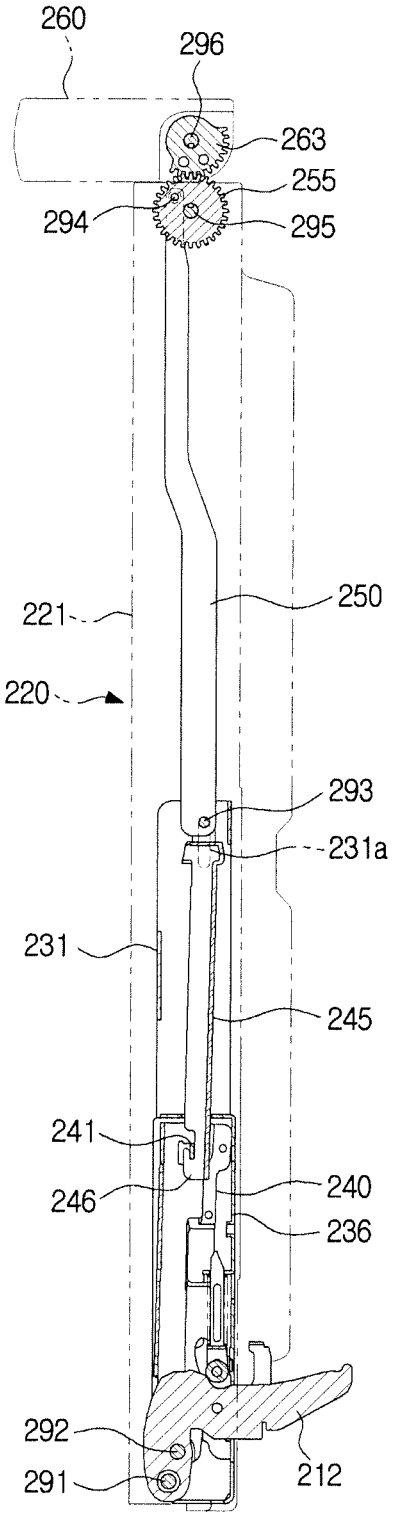
FIGS. 12 to 14 are cross-sectional views illustrating the link unit of FIG. 11, particularly.
Figure 13:
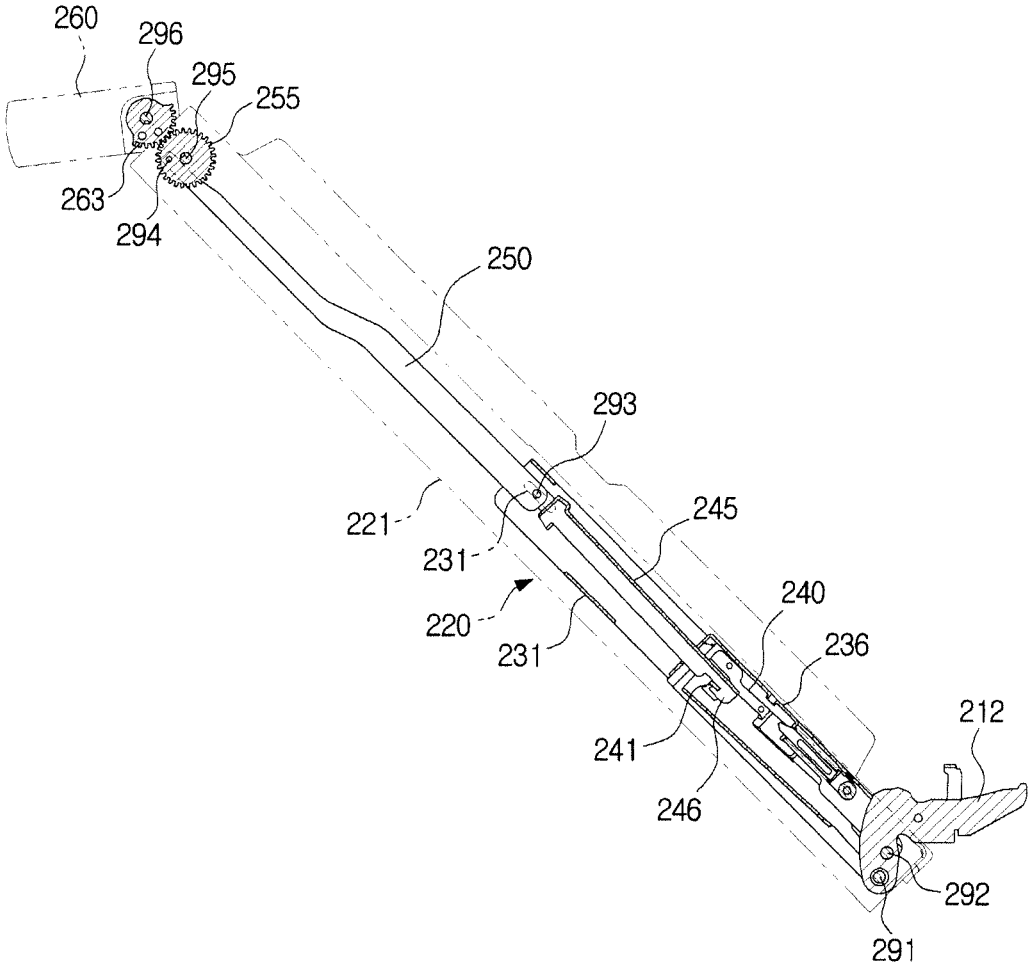
Figure 14:
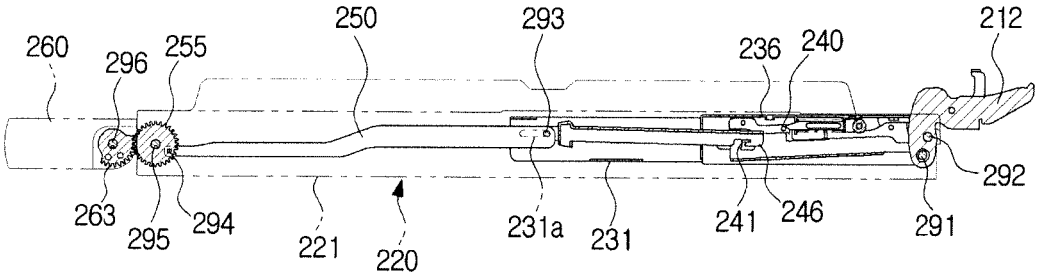

FIG. 11 is a view illustrating a link unit in accordance with another embodiment of the present disclosure. FIGS. 12 to 14 are cross-sectional views illustrating the link unit of FIG. 11, particularly, FIG. 12 illustrates a state in which a door 220 is closed, FIG. 13 illustrates a state in which the door 220 is half opened, and FIG. 14 illustrates a state in which the door 220 is fully opened.

A link unit according to another embodiment will be described with reference to FIGS. 11 to 14. The same components as those in the above-described embodiment will be given the same reference numerals, and description thereof will be omitted.

As mentioned above, a handle 260 may rotate in linkage with the rotation of a door 220 with respect to a body 10.

A link unit may include a hinge 212, link housings 231, 236, and 238, link rods 240, 245, and 250, a link gear 255, a handle gear 263, and a joint 291, 292, 293, 294, and 295.

The handle 260 may include a grip portion 261 and a spacer portion 262.

The door 220 may include the link housings 231, 236, and 238 fixed to a door body 221. The link housings 231, 236, and 238 may include an upper link housing 231, a lower link housing 236 and a gear housing 238.

The upper link housing 231 may include a guide groove 231*a* guiding a third joint 293. The guide groove 231*a* may be formed along a longitudinal direction of the upper link housing 231.

The link rods 240, 245, and 250 may include first link rods 240 and 245, and a second link rod 250. The first link rods 240 and 245 may include a first A link rod 240 and a first B link rod 245.

The first link rods 240 and 245, and the second link rod 250 may be rotatably coupled to each other.

According to another embodiment, the first A link rod 240 and the first B link rod 245 may be separately provided then integrated by coupling between a hook coupling portion 241 of the first A link rod 240 and a hook coupling portion 246 of the first B link rod 245. Alternatively, the first A link rod 240 and the first B link rod 245 may be integrally formed.

The link gear 255 and the second link rod 250 may be rotatably coupled to each other. The link gear 255 may be placed in the gear housing 238. The link gear 255 may be rotatable about the door 220 with respect to a fifth joint 295.

The link gear 255 may have a tooth portion 256 formed on the circumferential surface so as to engage with and rotate with the handle gear 263.

The handle gear 263 may be engaged with the link gear 255 and then rotated. For this, the handle gear 263 may have a tooth portion 264 formed on the circumferential surface.

When the handle gear 263 rotates, a handle gear rotating shaft 296, which is inserted into a handle gear rotating shaft hole 263*a* of the handle gear 263, may be rotated together with the handle gear 263. For this, a first interlocking groove 263*h* may be formed on the handle gear rotating shaft hole 263*a* and a first interlocking protrusion 297 may be formed in the handle gear rotating shaft 296.

When the handle gear rotating shaft 296 rotates, the handle 260 may be rotated together with the handle gear rotating shaft 296. For this, a second interlocking groove 298 may be formed in the handle gear rotating shaft 296, and a second interlocking protrusion 265 may be provided in the handle 260.

A handle gear rotating shaft hole 238*a* may be formed in the gear housing 238 of the door 220, and the handle gear rotating shaft 296 may be inserted into the handle gear rotating shaft hole 238*a* to prevent the handle 260 from escaping from the door 220.

The home appliance may include five joints 291, 292, 293, 294, and 295 so that the handle 260 rotates in linkage with the rotation of the door 220 with respect to the body 10.

The joints 291, 292, 293, 294, and 295 may allow two components to be rotatably coupled to each other and form a rotation axis of the two components.

A first joint 291 may allow the body 10 and the door 220 to be rotatably coupled to each other.

A second joint 292 may allow the body 10 and the first link rods 240 and 245 to be rotatably coupled to each other.

A third joint 293 may allow the first link rods 240 and 245 and the second rod 250 to be rotatably coupled to each other.

A fourth joint 294 may allow the second link rods 250 and the link gear 255 to be rotatably coupled to each other.

A fifth joint 295 may allow the link gear 255 and the door 220 to be rotatably coupled to each other.

As illustrated in FIGS. 12 to 14, by using the above mentioned structure, in a process in which the door 220 is opened, the first link rods 240 and 245 may pull the second link rod 250 due to a difference between a position of the first joint 291 and a position of the second joint 292.

When the first link rods 240 and 245 pull the second link rod 250, the link gear 255 may be rotated by a difference between a position of the fourth joint 294 and a position of the fifth joint 295 and the handle gear 263 engaged with the link gear 255 may be rotated so as to allow the handle 260 to be rotated.

Figure 15:
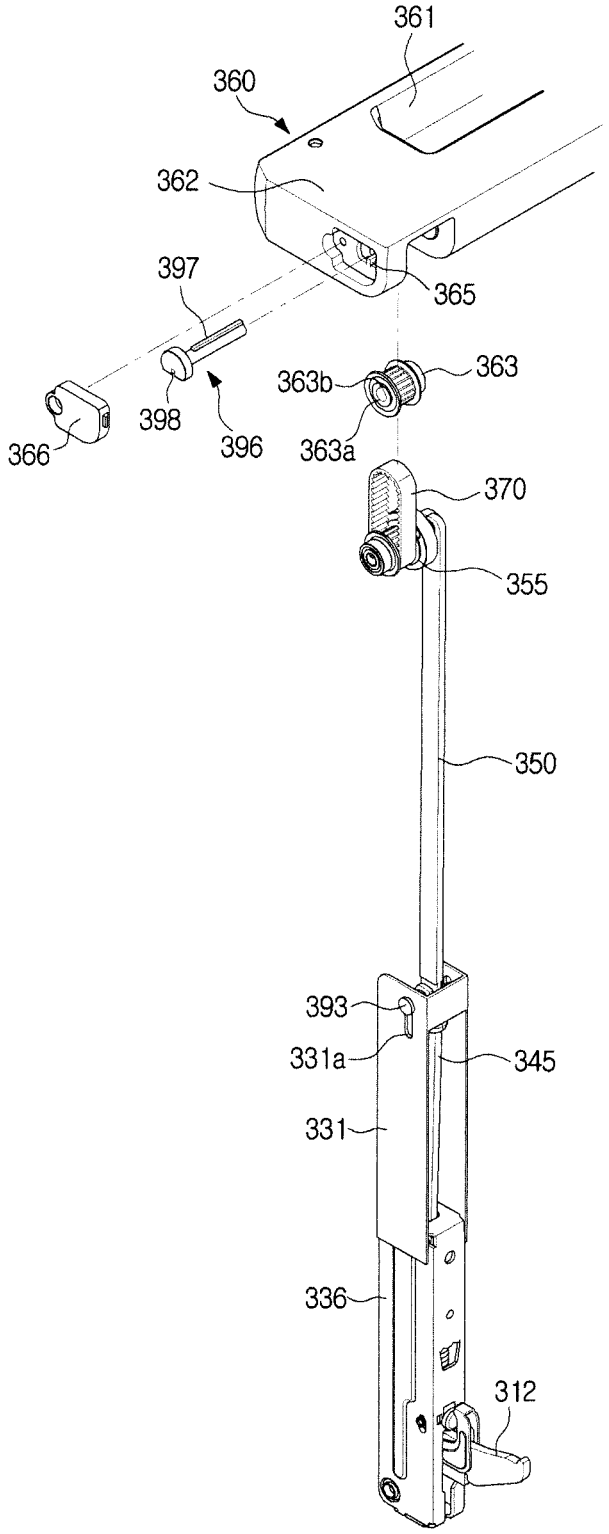
FIG. 15 is a view illustrating a link unit in accordance with another embodiment of the present disclosure.
Figure 16:
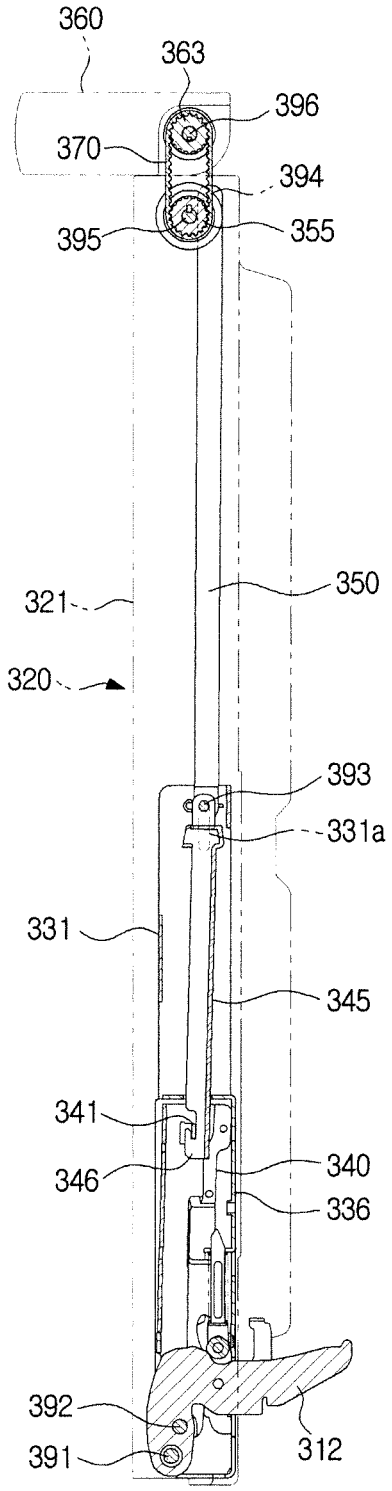
FIGS. 16 to 18 are cross-sectional views illustrating the link unit of FIG. 15, particularly.
Figure 17:
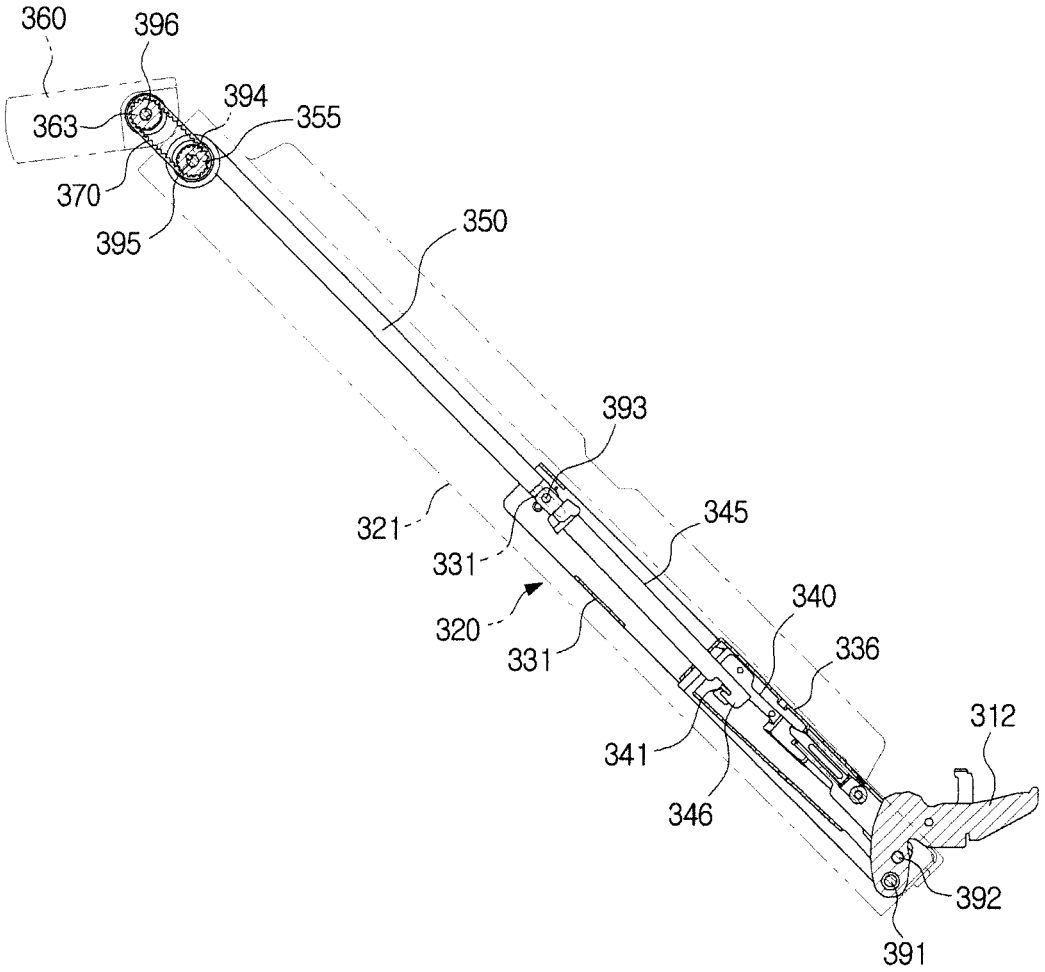
Figure 18:
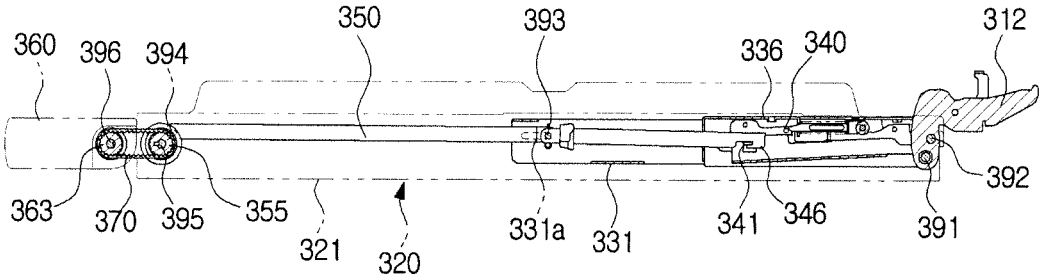

FIG. 15 is a view illustrating a link unit in accordance with another embodiment of the present disclosure. FIGS. 16 to 18 are cross-sectional views illustrating the link unit of FIG. 15, particularly, FIG. 16 illustrates a state in which a door 320 is closed, FIG. 17 illustrates a state in which the door 320 is half opened, and FIG. 18 illustrates a state in which the door 320 is fully opened.

A link unit according to another embodiment will be described with reference to FIGS. 15 to 18. The same components as those in the above-described embodiment will be given the same reference numerals, and description thereof will be omitted.

As mentioned above, a handle 360 may rotate in linkage with the rotation of a door 320 with respect to a body 10.

A link unit may include a hinge 312, link housings 331 and 336, link rods 340, 345, and 350, a handle pulley 363, a belt 370, and joints 391, 392, 393, 394, and 395.

The handle 360 may include a grip portion 361 and a spacer portion 362.

The door 320 may include the link housings 331 and 336 fixed to a door body 321. The link housings 331 and 336 may include an upper link housing 331 and a lower link housing 336.

The upper link housing 331 may include a guide groove 331*a* guiding a third joint 393. The guide groove 331*a* may be formed along a longitudinal direction of the upper link housing 331.

The link rods 340, 345, and 350 may include first link rods 340 and 345, and a second link rod 350. The first link rods 340 and 345 may include a first A link rod 340 and a first B link rod 345.

The first link rods 340 and 345 and the second link rod 350 may be rotatably coupled to each other.

According to another embodiment, the first A link rod 340 and the first B link rod 345 may be separately provided then integrated by coupling between a hook coupling portion 341 of the first A link rod 340 and a hook coupling portion 346 of the first B link rod 345. Alternatively, the first A link rod 340 and the first B link rod 345 may be integrally formed.

The link pulley 355 may be rotatably coupled to the second link rod 350. The link pulley 355 may be rotatable about the door 320 with respect to the fifth joint 395.

A handle pulley 363 may be connected to the link pulley 355 by the belt 370 and then rotated.

When the handle pulley 363 rotates, a handle pulley rotating shaft 396, which is inserted into a handle pulley rotating shaft hole 363*a* of the handle pulley 363, may be rotated together with the handle pulley 363. For this, a first interlocking groove 363*h* may be formed on the handle pulley rotating shaft hole 363*a* and a first interlocking protrusion 397 may be formed in the handle pulley rotating shaft 396.

When the handle pulley rotating shaft 396 rotates, the handle 360 may be rotated together with the handle pulley rotating shaft 396. For this, a second interlocking groove 398 may be formed in the handle pulley rotating shaft 396 and a second interlocking protrusion 365 may be provided in the handle 360.

Since the link pulley 355 and the handle pulley 363 are connected by the belt 370, it may be possible to prevent the handle 360 from escaping from the door 320.

The home appliance may include five joints 391, 392, 393, 394, and 395 so that the handle 360 rotates in linkage with the rotation of the door 320 with respect to the body 10.

The joints 391, 392, 393, 394, and 395 may allow two components to be rotatably coupled to each other and form a rotation axis of the two components.

A first joint 391 may allow the body 10 and the door 320 to be rotatably coupled to each other.

A second joint 392 may allow the body 10 and the first link rods 340 and 345 to be rotatably coupled to each other.

A third joint 393 may allow the first link rods 340 and 345 and the second rod 350 to be rotatably coupled to each other.

A fourth joint 394 may allow the second link rod 350 and the link pulley 355 to be rotatably coupled to each other.

A fifth joint 395 may allow the link pulley 355 and the door 320 to be rotatably coupled to each other.

As illustrated in FIGS. 16 to 18, by using the above mentioned structure, in a process in which the door 320 is opened, the first link rods 340 and 345 may pull the second link rod 350 due to a difference between a position of the first joint 391 and a position of the second joint 392.

When the first link rods 340 and 345 pull the second link rod 350, the link pulley 355 may be rotated by a difference between a position of the fourth joint 394 and a position of the fifth joint 395, and the handle pulley 363 may be rotated by the belt 370 so as to allow the handle 360 to be rotated.

As is apparent from the above description, it may be possible to improve the convenience in the opening and closing operation of the door, since the handle is rotated with respect to the door according to the opening and closing operation of the door.

It may be possible to allow the handle to be smoothly and readily rotated since the opening and closing operation of the door is linked with the rotation movement of the handle by five joints.

Since the latch, which is configured to fix the door to the body, is moved to a position parallel to the door, when the door is opened, it may be possible to prevent a user from being disturbed or interrupted by the latch while using the cavity after opening the door.

Although a few embodiments of the present disclosure have been shown and described, it would be appreciated by those skilled in the art that changes may be made in these embodiments without departing from the principles and spirit of the disclosure, the scope of which is defined in the claims and their equivalents.

| Description of symbols | |
|---|---|
| 1: home appliance | 10: body |
| 11: cavity | 12: hinge bracket |
| 20: door | 31: upper link housing |
| 36: lower link housing | 37: guide groove |
| 40: first link rod | 50: second A link rod |
| 55: second B link rod | 57: guide protrusion |
| 60: handle | 70: latch |
| 91: first joint | 92: second joint |
| 93: third joint | 94: fourth joint |
| 95: fifth joint | 96: latch rotating shaft |
| 255: link gear | 263: handle gear |
| 355: link pulley | 363: handle pulley |
| 370: belt | |

What is claimed is:

1. A home appliance comprising:

a body having a cavity;

a door rotatably coupled to the body to open and close the cavity;

a handle rotataby coupled to a bracket on the door;

a hinge bracket hingedly coupling the door to the body;

a latch coupled to the door, the latch being configured to fix the door to the body when the door closes the cavity of the body of the home appliance in a latch position and to unfix the door from the body in an unlatched position; and first and second link rods positioned on the door, the first link rod having one end operatively coupled to the hinge bracket and an opposed end coupled to the second link rod, and an opposed end of the second link rod is operatively coupled to the bracket, wherein, when the handle is pulled in order to move the door to open the cavity, the hinge bracket linearly moves the first and second link rods toward the hinge bracket, and the handle is then capable of rotating, allowing a portion of the second link rod to press a portion of the latch in order to move the latch toward the unlatched position.

2. The home appliance of claim 1, wherein the second link rod is configured to move linearly with respect to the door.

3. The home appliance of claim 2, wherein the second link rod includes a guide protrusion, and the door includes an elongated guide groove configured to guide the guide protrusion when the second link rod moves linearly with respect to the door.

4. The home appliance of claim 2, wherein the latch is configured to rotate in linkage with the second link rod when the second link rod moves linearly with respect to the door.

5. The home appliance of claim 4, wherein the second link rod includes a pressing portion configured to press the latch to rotate the latch, and the latch includes an active portion interrupted by the pressing portion.

6. The home appliance of claim 1, wherein the latch includes a locking portion configured to fix the latch to the door when the door closes the cavity, and the latch is configured so that, when the latch is in the latched position, the locking portion is perpendicular to a rear surface of the door, and when the latch is in the unlatched position, the locking portion is parallel to the rear surface of the door.

7. The home appliance of claim 6, wherein the latch is placed in the latched position when the door closes the cavity, and the latch is rotated between the latched position and the unlatched position when the door is rotated to open the cavity.

8. The home appliance of claim 1, further comprising:

a first joint configured to allow the body and the door to be rotatably coupled to each other;

a second joint configured to allow the body and the first link rod to be rotatably coupled to each other;

a third joint configured to allow the first link rod and the second link rod to be rotatably coupled to each other;

a fourth joint configured to allow the second link rod and the handle to be rotatably coupled to each other; and a fifth joint configured to allow the door and the handle to be rotatably coupled to each other.

9. The home appliance of claim 8, further comprising:

a sixth joint configured to allow the door and the latch to be rotatably coupled to each other.

* * * * *